US012103068B2

(12) United States Patent
Kroeger et al.

(10) Patent No.: US 12,103,068 B2
(45) Date of Patent: Oct. 1, 2024

(54) SMART TRIM DIE ASSEMBLY

(71) Applicant: MAGNA INTERNATIONAL INC., Aurora (CA)

(72) Inventors: Wally Kroeger, Tianjin (CN); Joyce Liu, Tianjin (CN); Owen Li, Tianjin (CN); Lee Zhao, Tianjin (CN); Les Shuman, Brampton (CA)

(73) Assignee: MAGNA INTERNATIONAL INC., Aurora (CA)

( * ) Notice: Subject to any disclaimer, the term of this patent is extended or adjusted under 35 U.S.C. 154(b) by 11 days.

(21) Appl. No.: 17/923,642

(22) PCT Filed: May 6, 2020

(86) PCT No.: PCT/CN2020/088712
§ 371 (c)(1),
(2) Date: Nov. 7, 2022

(87) PCT Pub. No.: WO2021/223092
PCT Pub. Date: Nov. 11, 2021

(65) Prior Publication Data
US 2023/0182199 A1 Jun. 15, 2023

(51) Int. Cl.
*B22D 17/32* (2006.01)
*B22D 17/20* (2006.01)
*B22D 17/22* (2006.01)

(52) U.S. Cl.
CPC ..... *B22D 17/32* (2013.01); *B22D 17/2076* (2013.01); *B22D 17/22* (2013.01)

(58) Field of Classification Search
CPC .... B22D 17/20; B22D 17/2076; B22D 17/22; B22D 17/32
(Continued)

(56) References Cited

U.S. PATENT DOCUMENTS 4,489,584 A 12/1984 Gall et al.

FOREIGN PATENT DOCUMENTS

CN 103170536 A 6/2013
CN 203711638 U 7/2014
(Continued)

OTHER PUBLICATIONS

Machine translation of CN 104588505 A (Year: 2015).*
European Patent Application 20934439.9—Extended European Search Report dated Feb. 6, 2024.

*Primary Examiner* — Kevin P Kerns
(74) *Attorney, Agent, or Firm* — Dickinson Wright PLLC

(57) ABSTRACT

A smart trim die assembly for providing multiple internal operations during a stroke is provided. The smart trim die assembly includes a first die, a second die, and a cavity formed between the first die and second die. A plurality of sensors are located between the first die and the second die for measuring the distance therebetween during a stroke. A series of tools are integrated into one of the first die or second die and each perform one of trimming, piercing, dimpling, and tapping operations. The smart trim die assembly further includes a processor and a memory device for receiving readings from the sensors. The memory device further contains instructions that, when executed by the processor, cause the processor to, in response to the sensor reading a predetermined distance, instruct the series of tools to perform one or more of the operations.

18 Claims, 21 Drawing Sheets

(58) Field of Classification Search
USPC ..... 164/151.2, 154.2, 271, 284, 303, 339, 164/342
See application file for complete search history.

(56) References Cited

FOREIGN PATENT DOCUMENTS

| | | | | | |
|---|---|---|---|---|---|
| CN | 204234569 | U | | 4/2015 | |
| CN | 104588505 | A | * | 5/2015 | ..... B21D 5/06 |
| CN | 204564917 | U | | 8/2015 | |
| CN | 105013884 | A | | 11/2015 | |
| CN | 205032505 | U | | 2/2016 | |
| CN | 105855348 | A | | 8/2016 | |
| CN | 206810934 | U | | 12/2017 | |
| CN | 206868925 | U | | 1/2018 | |
| CN | 207119686 | U | | 3/2018 | |
| CN | 108405714 | A | | 8/2018 | |
| CN | 108817203 | A | | 11/2018 | |
| CN | 108971932 | A | | 12/2018 | |
| CN | 208322054 | U | | 1/2019 | |
| DE | 10246420 | A1 | | 4/2004 | |
| JP | 2005138157 | A | | 6/2005 | |
| WO | 2004034506 | A1 | | 4/2004 | |

* cited by examiner

SMART TRIM DIE ASSEMBLY

CROSS REFERENCE TO RELATED APPLICATIONS

This U.S. National Stage Patent application claims the benefit of PCT International Patent Application Serial No. PCT/CN2020/088712 filed May 6, 2020 entitled "SMART TRIM DIE ASSEMBLY", the entire disclosure of which is hereby incorporated by reference.

BACKGROUND OF THE INVENTION

1. Field of the Invention

The present invention relates a smart trim die assembly. More particularly, the present invention relates to a smart trim die assembly with a sensor for facilitating at least one of piercing, holding, punching, dimpling, and tapping within the die based on the die stroke positioning.

2. Related Art

This section provides background information related to the present disclosure which is not necessarily prior art.

Casting is a popular production process wherein a molten material is injected within a casting assembly and allowed to cool into a useful shape. Some of the known advantages of the casting process include quickly forming relatively sturdy and complex shapes without much material waste. Because of these known efficiencies, casting has been widely adopted by the automobile industry, for example, forming automotive body components. However, despite these advantages, casting is both time and space intensive and relatively limited to performing only casting operations. Because of the limited operations that can be performed by traditional casting assemblies, production must be spread out to numerous machines. For example, once the molten material has been cooled into a useful shape it must be moved between additional machines that can perform trimming, piercing, and tapping operations. Because the casted part must be moved between many locations or machines, inconsistences can be present throughout an entire production cycle.

Accordingly, there is a continuing desire to further develop and refine casting processes to limit the amount of inconsistences within a production cycle and to more fully utilize the casting assemblies to perform operations in addition to shaping.

SUMMARY OF THE INVENTION

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims. This section provides a general summary of the disclosure and is not to be interpreted as a complete and comprehensive listing of all of the objects, aspects, features and advantages associated with the present disclosure.

According to one aspect of the disclosure, a smart trim die assembly is provided. The smart trim die assembly comprises a first die and a second die moveable relative to the first die between an open position and a closed portion. A cavity is formed between the first die and second die in the closed position for casting a part. The smart trim die assembly further includes at least one sensor for measuring the distance between the first die and the second die. A first tool is integrated into the first die or second die for performing one of piercing, holding, punching, dimpling, and tapping operations. A processor and a memory device for receiving measurements from the at least one sensor are also provided. The memory device contains instructions that, when executed by the processor, cause the processor to, in response to the sensor reading a predetermined distance, instruct the first tool to perform one of the piercing, holding, punching, dimpling, and tapping operations.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein.

DESCRIPTION OF THE ENABLING EMBODIMENT

Example embodiments will now be described more fully with reference to the accompanying drawings. In general, the subject embodiments are directed to a smart trim die assembly. However, the example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Referring to the Figures, wherein like numerals indicate corresponding parts throughout the views, the smart trim die assembly provides both shaping functionality and at least one of piercing, holding, punching, dimpling, and tapping operations within the die based on the die stroke positioning.

Figure 1:
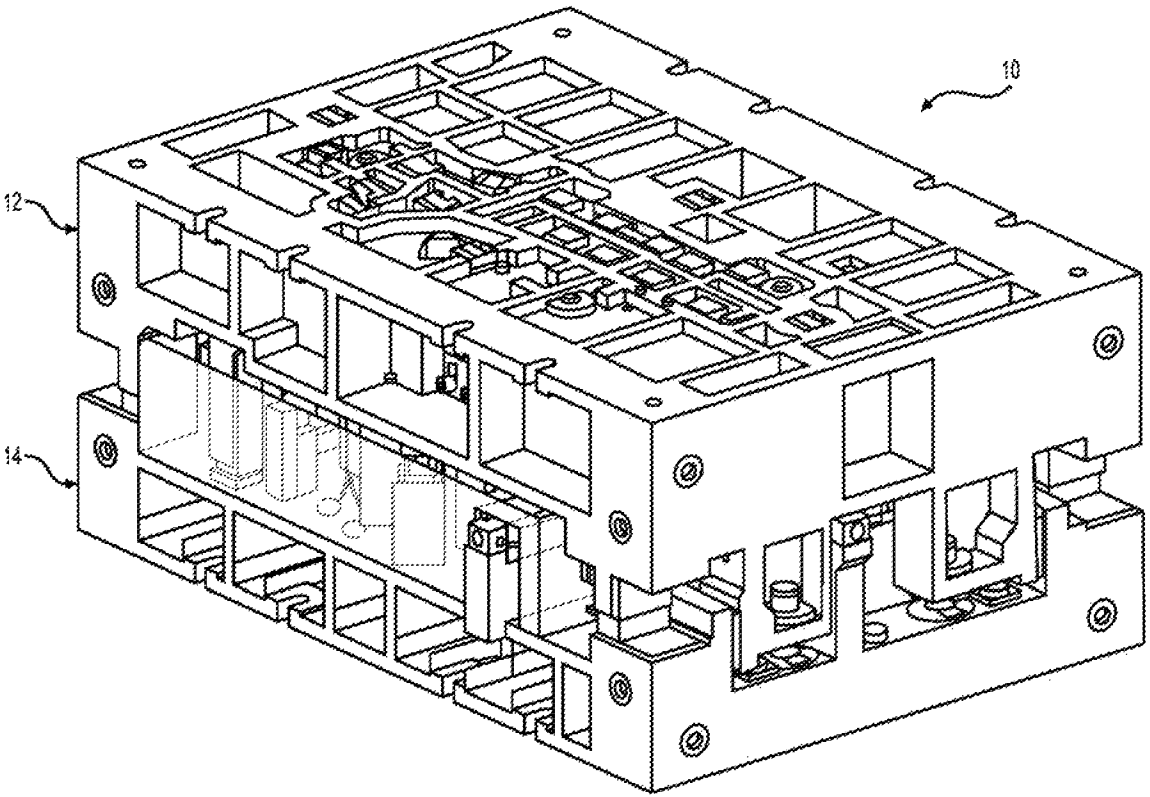
FIG. 1 is a perspective view of a smart trim die assembly including an upper die and a lower die in a closed positon.
Figure 2:
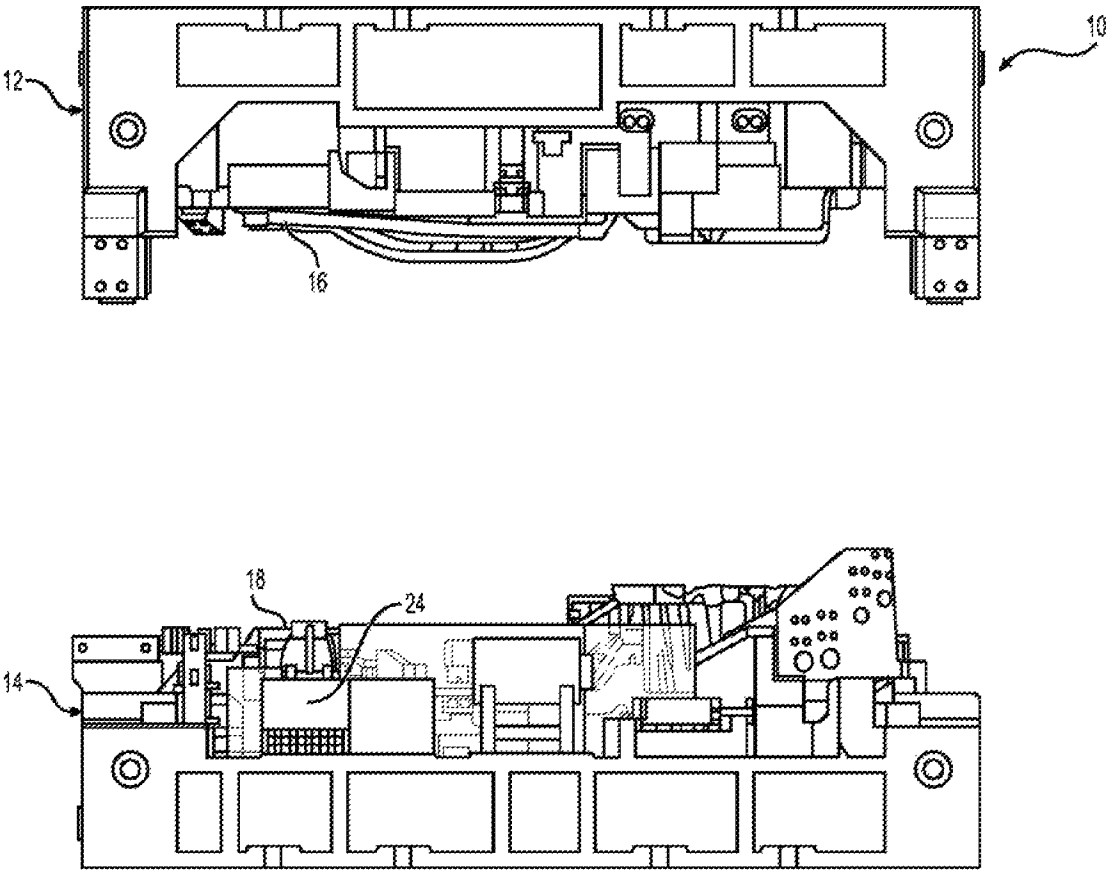
FIG. 2 is a side view of the smart trim die assembly wherein the upper die and lower die are in an open position.

Referring initially to FIGS. 1 and 2 the smart trim die assembly 10 is generally shown. The smart trim die assembly 10 includes an upper die 12 and a lower die 14. A the upper die 12 includes an upper shaping surface 16 and the lower die 14 includes a lower shaping surface 18. A forming cavity 20 (FIG. 3A) is defined between the upper shaping surface 16 and the lower shaping surface 18 that forms the casted part. The upper die 12 and lower die 14 are moveable relative to one another during a stroke between a closed positon (FIG. 1), an open position (FIG. 2), and intermediary positions between the closed position and the open position. The smart trim die assembly 10 further includes at least one sensor and typically a plurality of sensors 22A-22G (FIG. 4B). The sensors 22A-22G are in operable communication with a CPU 24 that measures the stroke position, such as the distance between the upper shaping surface 16 and lower shaping surface 18, and signals to the CPU 24 to facilitate operations in addition to shaping including at least one of piercing, holding, punching, dimpling, and tapping operations.

Figure 3A:
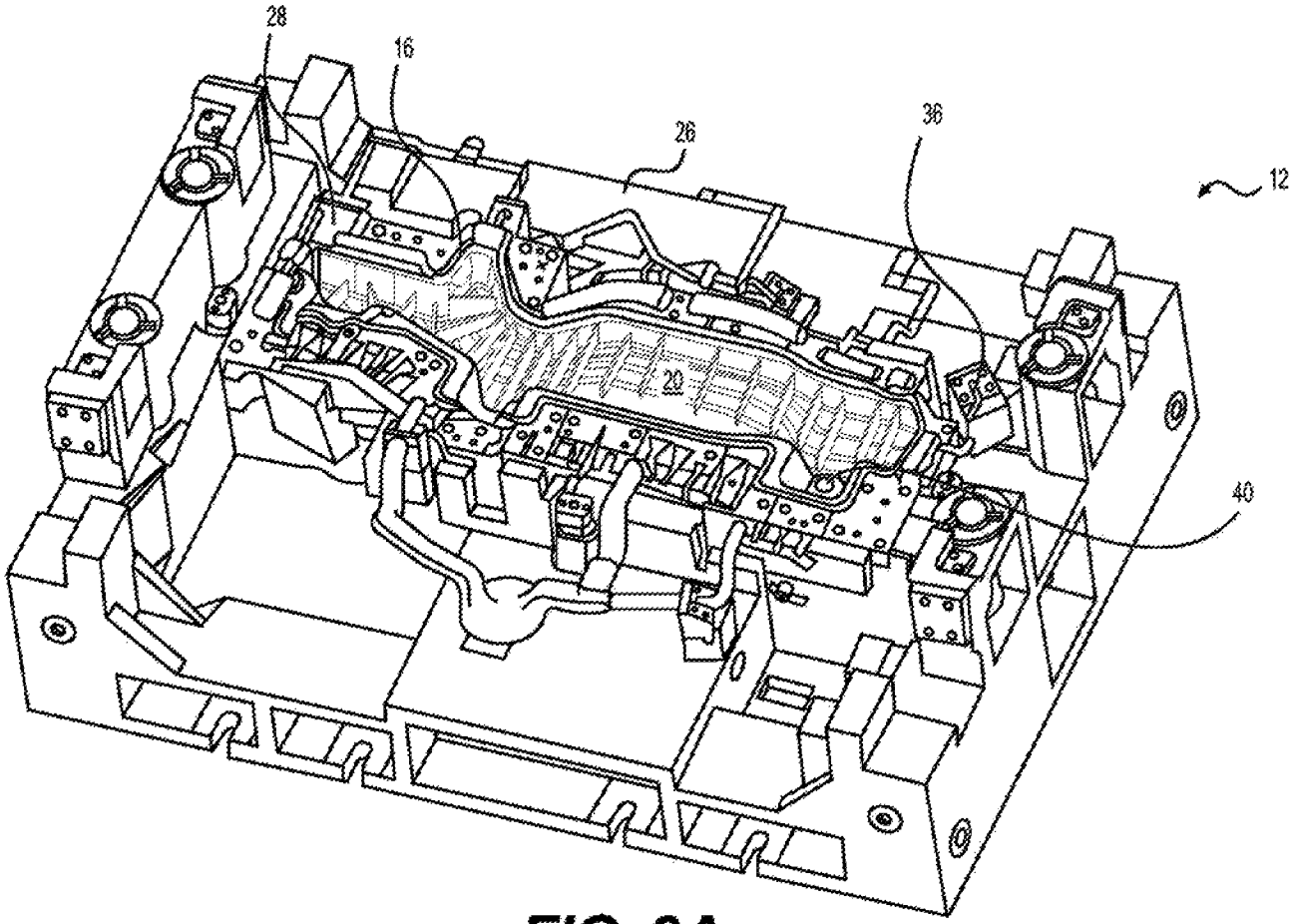
FIG. 3A is a bottom perspective view of an upper die surface of the upper die.
Figure 3B:
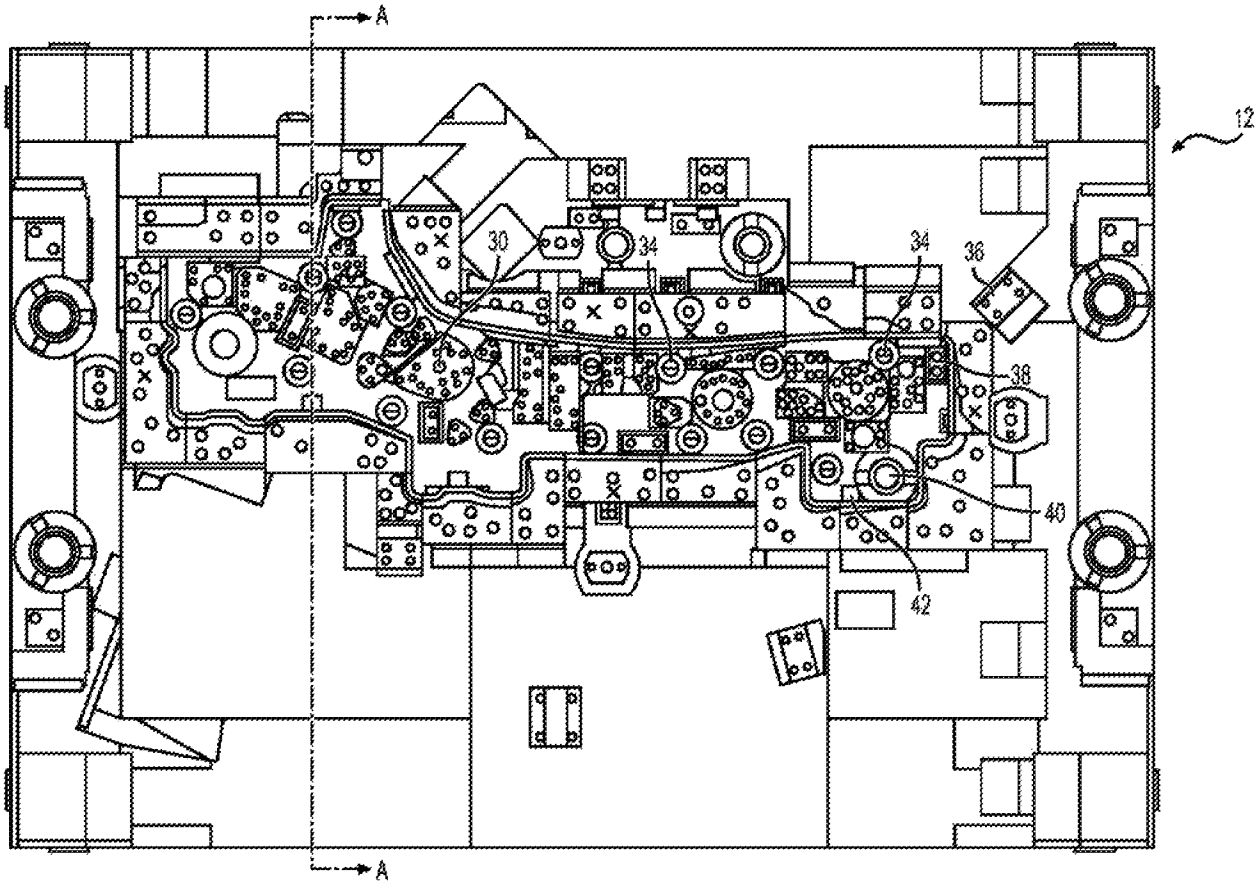
FIG. 3B is a bottom plan view of the upper die surface.
Figure 3C:
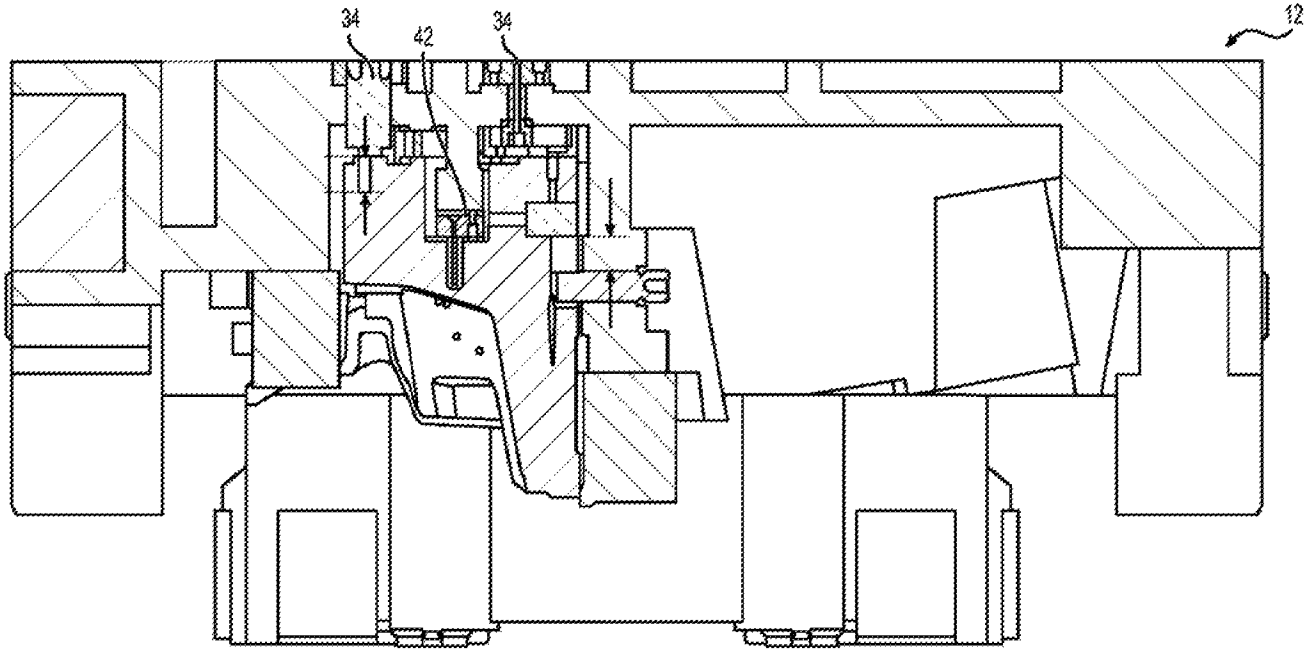
FIG. 3C is a cross-sectional view of the upper die surface taken along the line A-A presented in FIG. 3B.
Figure 3D:
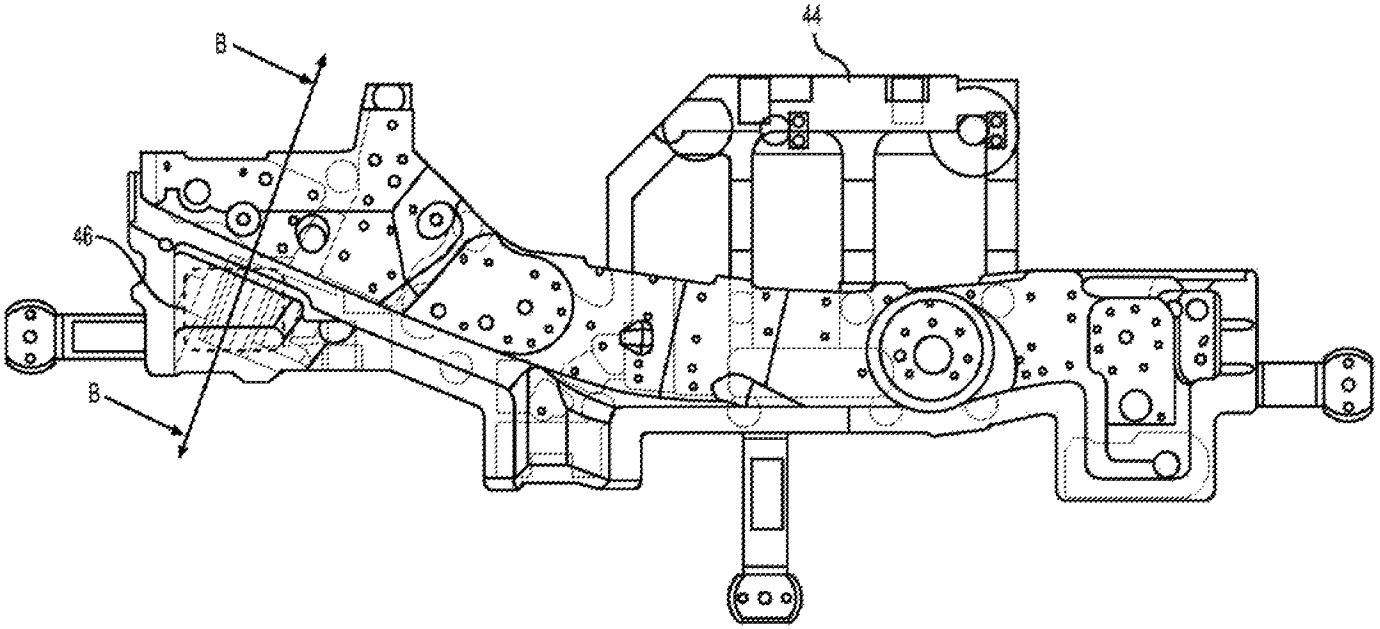
FIG. 3D is an interior view of the upper die illustrating the location of an upper pad and a punch and dimple assembly.
Figure 4A:
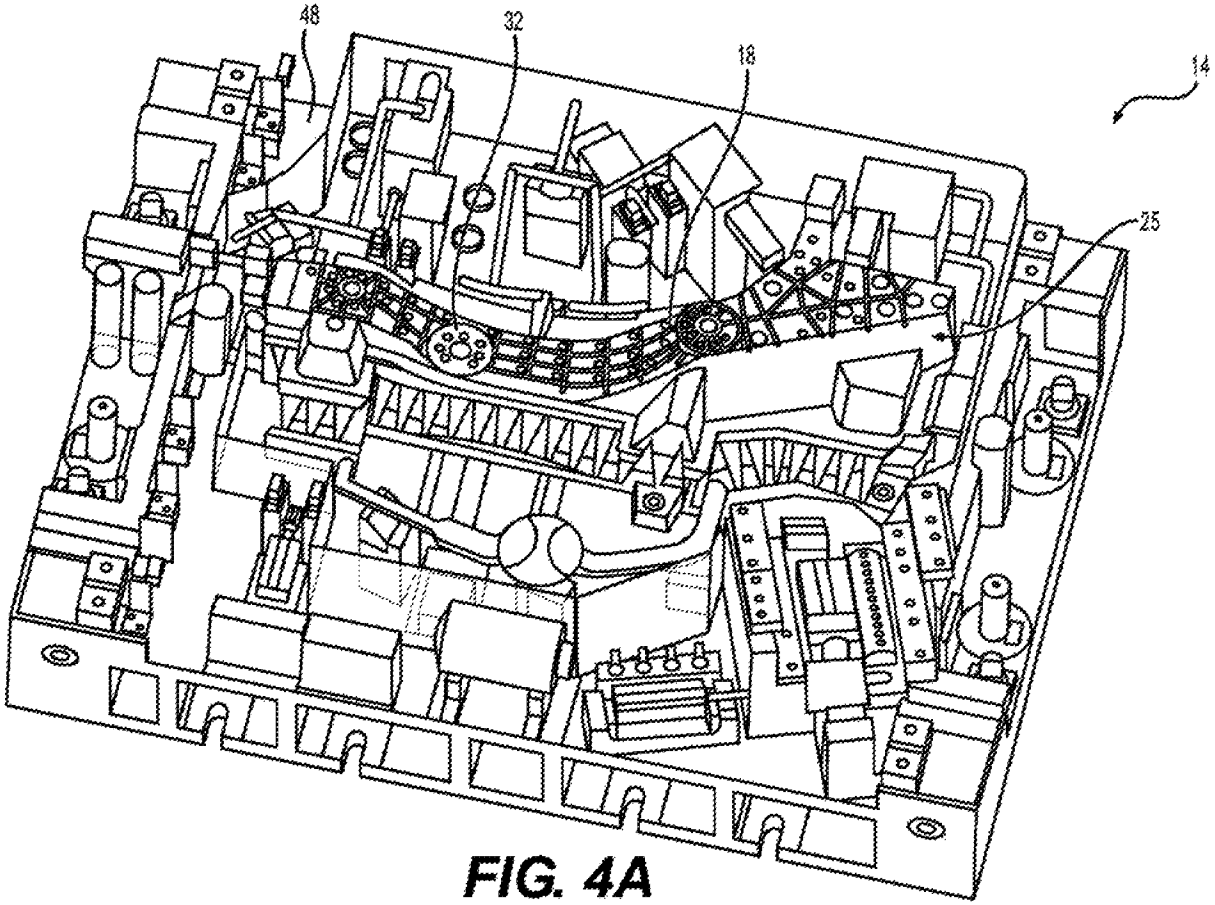
FIG. 4A a top perspective view of a lower die surface of the lower die.
Figure 4B:
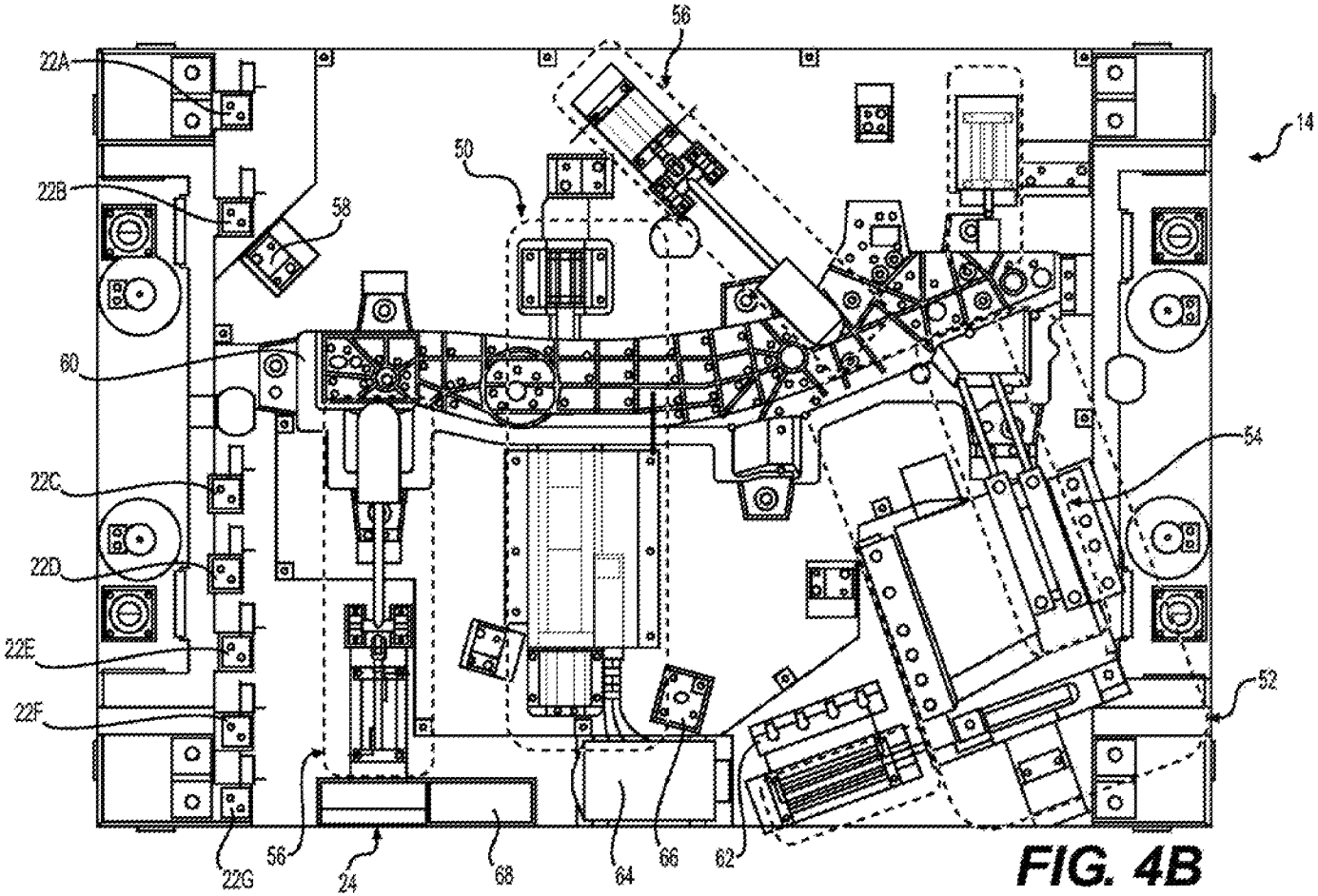
FIG. 4B is a top plan view of the lower die surface.

With reference now to FIGS. 3A and 3B, the upper die 12 is illustrated from a bottom view. The upper shaping surface 16 is defined by an upper die shoe 26, which locates multiple components/tools on the upper die 12. An upper trim plate 28, which may be formed of steel, extends around the boundary of the cavity 20 for providing an outline of a shaped part 25. The upper die 12 further includes a plurality of upper punches 30 extending into the cavity 20 for forming openings 32 within the shaped part 25 (FIG. 4A). A plurality of springs 34, such as gas springs, are located on the upper die shoe 26 and extend into the cavity 20. A plurality of runner cutters 36 are located on the upper die shoe 26 for cutting excess runner material from the shaped part 25. A plurality of bottom blocks 38 are located on the upper die shoe 26 and extend into the cavity 20 for bottoming out the upper die 12 and allowing re-striking of the casted part. A plurality of guide pins 40 are at least partially located in upper die 12 for facilitating linear movement during the opening and closing of the smart trim die assembly 10. A plurality of side pins 42 are located partially within the upper die shoe 26 for controlling relative stroke movement. More particularly, as illustrated in the cross-sectional view of FIG. 3C, when the gas springs 34 are released, the side pins 42 can stop the relative movement between the upper die 12 and the lower die 14. As best shown in FIG. 3D, the interior of the upper die 12 includes an upper pad 44 and a punch and dimple assembly 46.

With reference now to FIGS. 4A and 4B, the lower die 14 is illustrated from a top view. The lower shaping surface 18 is defined by a lower die shoe 48, which locates multiple components of the lower die 14. A tapping assembly 50 is located on the lower die shoe 48 and performs tapping functionality to various locations along the shaped part 25. A lower CAM assembly 52 is located on the lower die shoe 48 and includes a lower pierce assembly 54. A plurality of lower pressure block assemblies 56 are located around the cavity 20. A plurality of lower trim plates 58 are located on the lower die shoe 48 and work cooperatively with the runner cutters 36 on the upper die shoe 26. At least one lower post 60 is located on the lower die shoe 48 and provides a shaping surface for the casted part 25. A hydraulic manifold 62 is operably connected to various components of the lower die 14 and provides hydraulic fluid actuation thereto from an oil reservoir 64. At least one runner biscuit supporter 66 is located on the lower die shoe 48 for bracing any leftover biscuit material. The sensors 22A—22G are located on the lower shoe die 48 that are in operable communication with the CPU 24. Each sensor 22A-22G signals the CPU 24 upon a designated stroke position. For example, the sensors may include a first sensor 22A monitoring for a predetermined first stroke position, such as a distance between the upper shaping surface 16 and the lower shaping surface 18. Once the stroke position is at the predetermined first stroke position, the first sensor 22A signals the CPU 24 to initiate one of the piercing, holding, punching, dimpling, and tapping operations. The sensors may further include a second sensor 22B for monitoring a predetermined second stroke position. Once the stroke position is at the predetermined second stroke position, the second sensor 22B signals the CPU 24 to initiate a different one of the piercing, holding, punching, dimpling, and tapping operations from that signaled by the first sensor 22A. The sensors may further include a third sensor 22C for monitoring a predetermined third stroke position and signaling the CPU 24 to perform another of the piercing, holding, punching, dimpling, and tapping operations. It should also be appreciated that the sensors may further includes additional sensors 22D—22G for the additional operations. The lower die 14 further includes a motor 68, such as a servo motor, in operable communications with the CPU 24. The motor 68 may control the output of the oil.

Figure 5A:
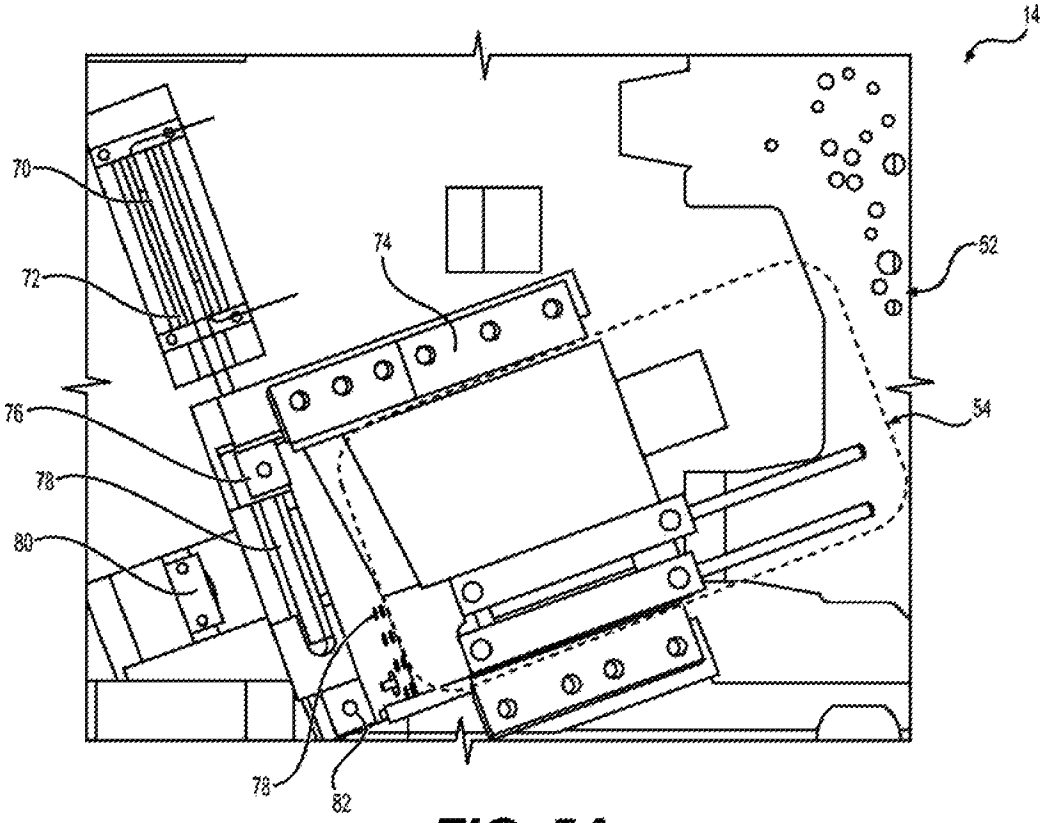
FIG. 5A is enlarged view of the lower die illustrating a lower pierce assembly on the lower die surface.
Figure 5B:
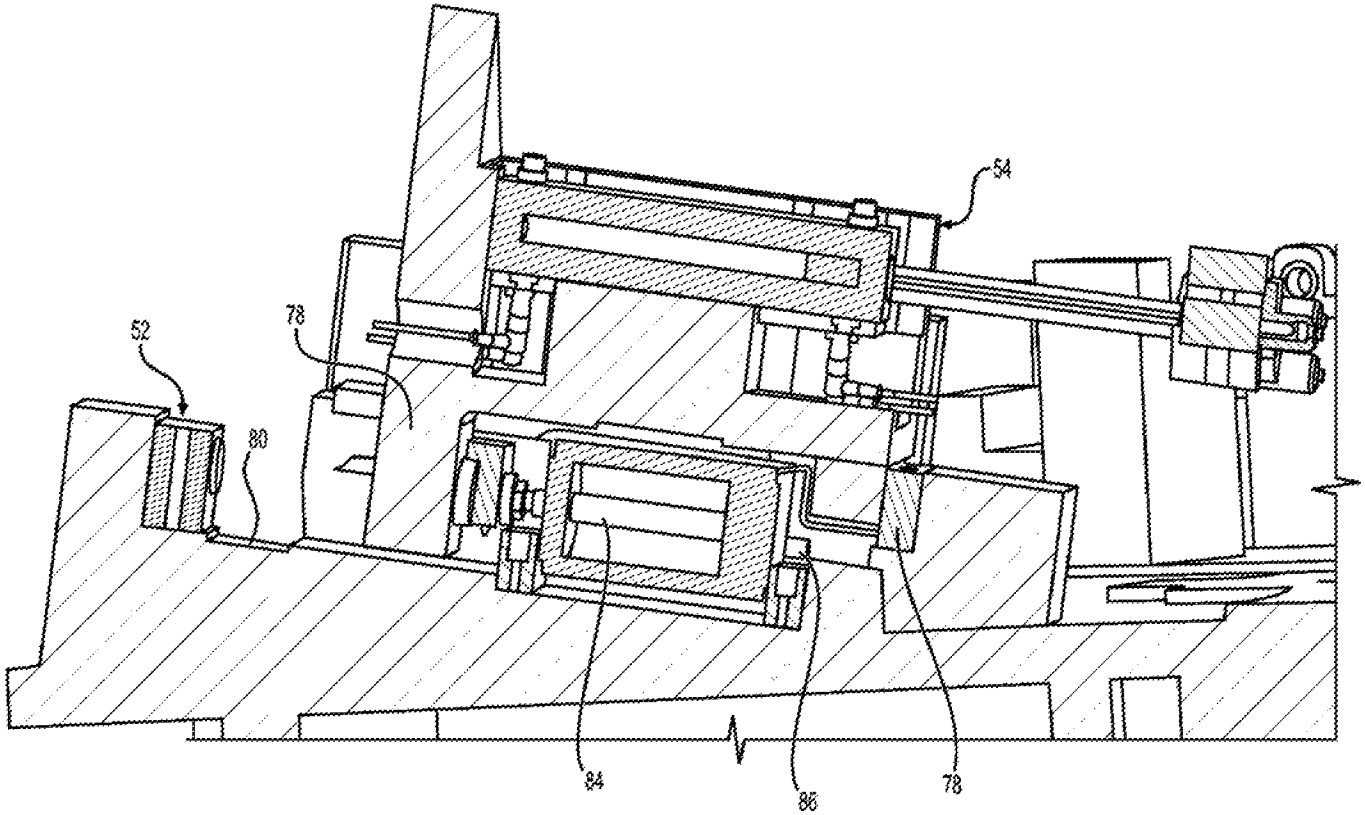
FIG. 5B is a side view of the lower pierce assembly and a CAM assembly located below the lower pierce assembly that moves the lower pierce assembly relative to a casted part.
Figure 5C:
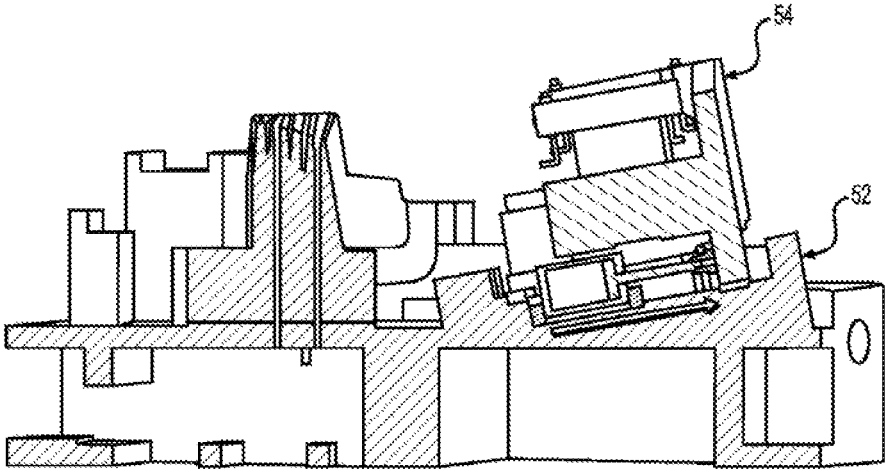
FIG. 5C is another side view of the lower pierce assembly, wherein the lower pierce assembly is in a retracted position.
Figure 5D:
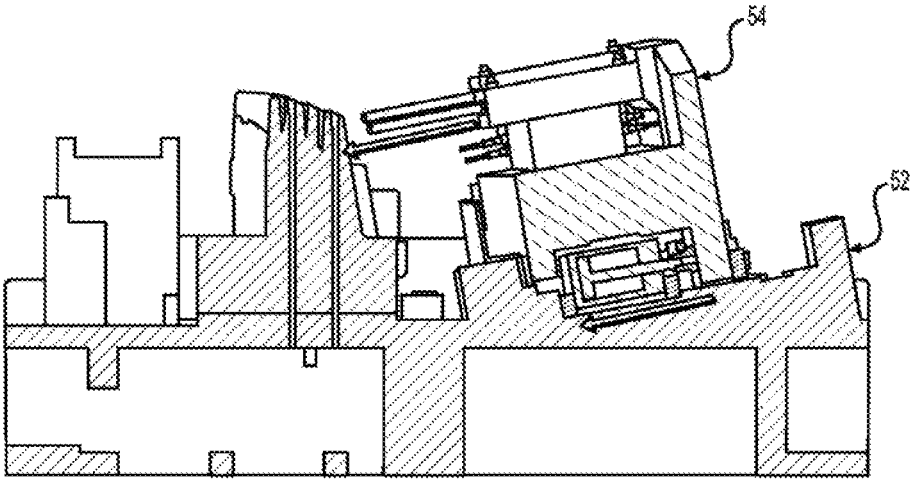
FIG. 5D is yet another side view of the lower pierce assembly, wherein the lower pierce assembly is in an extended position.

The lower CAM assembly 52 and lower pierce assembly 54 are shown best in FIGS. 5A through 5D. The lower CAM assembly 52 moves the lower pierce assembly 54 to increase the return stroke range of the pierce assembly 54. The lower CAM assembly 52 includes a first air cylinder 70 and a first cylinder sensor 72 for effectuating back and forth movement of the lower pierce assembly 54 in a first direction. The first cylinder sensor 72 is in operable communication with the CPU 24 and measures and relays the cylinder 70 position. The lower CAM assembly 52 further includes a cam gib plate 74, a wear plate 76, a plurality of stop blocks 78, a cam slide 80, and a wear plate 82. In operation, the CAM assembly 52 moves the lower pierce assembly 54 by sliding the cam gib plate 74 over the wear plate 76 and the wear plate 82. As illustrated best in FIG. 5B, the lower CAM assembly 52 further includes a second air cylinder 84 and a second cylinder sensor 86 for effectuating back and forth movement of the lower pierce assembly 54 in a second direction. The second cylinder sensor 86 is in operable communication with the CPU 24 and measures and relays the second cylinder 84 position. The cam slide 80 is a stopper that restricts movement so that when the cam is pushed back by at least one of the air cylinders 70, 84, it is stopped by cam slide 80. Operation of the lower CAM assembly 52 is illustrated in FIGS. 5C and 5D. In FIG. 5C, the second air cylinder 84 is expanded such that the lower pierce assembly 54 is spaced from the shaped part 25. In FIG. 5D, the air cylinder 84 has been retracted to move the lower piercing assembly 54 along the cam slide 80, closer to, and within piercing range of the shaped part 25. In one example operation, during an stroke, once the upper die 12 and lower die 14 are moved apart by a predetermined distance (e.g., approximately 100 mm) one of the distance sensors 22A-22G conveys a reading to the CPU 24. The CPU 24 in return causes the second air cylinder 84 to press against a stop block 78 and cause sliding movement of the pierce assembly 54 along the cam slide 80 approximately 110 mm towards the part 25 to perform piercing operations. Once the upper die 12 and lower die 14 are moved further apart by a second predetermined distance (e.g., approximately 200 mm) one of the distance sensors 22A-22G conveys a reading to the CPU 24. The CPU 24 in return causes the second air cylinder 84 to return the pierce assembly 54 to its previous position.

Figure 6:
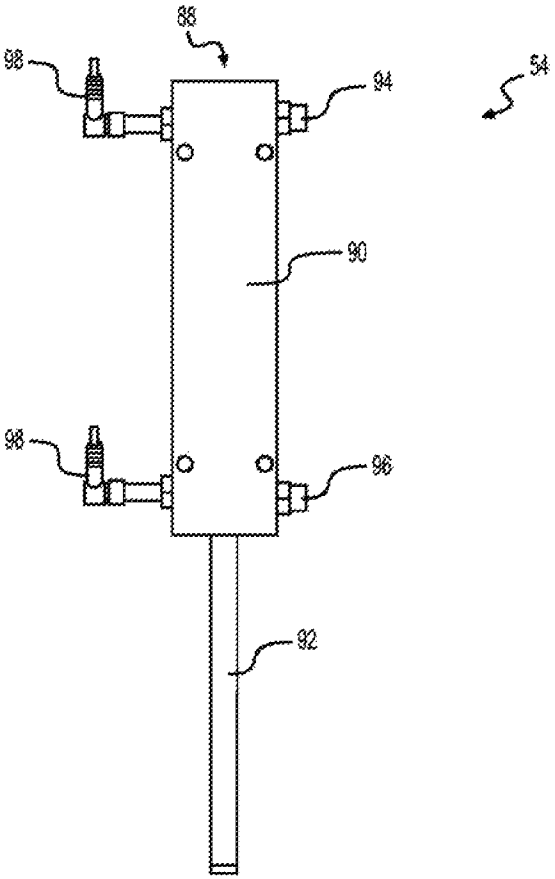
FIG. 6 illustrates a hydraulic piercing assembly of the lower pierce assembly.

The lower pierce assembly 54 includes at least one hydraulic piercing assembly 88 as illustrated best in FIG. 6. In the illustrated arrangement, the at least one hydraulic piercing assembly 88 includes a pair of hydraulic piercing assemblies 88. Each hydraulic piercing assembly 88 includes a hydraulic cylinder 90 and a piercing rod 92 that is moved within the hydraulic cylinder 90 as pressurized oil is introduced therein. The hydraulic piercing assembly 88 further includes an oil inlet 94 for introducing oil into the hydraulic cylinder 90 and an oil outlet 96 for removing oil from the hydraulic cylinder 90. A first and second piercing assembly sensor 98 extend from the hydraulic cylinder 90 and may each include an LED sensor with a cable attachment. In operation, during a stroke, once the upper die 12 and lower die 14 are moved apart by a predetermined distance (e.g., approximately 10 mm) one of the distance sensors 22A-22G conveys a reading to the CPU 24. The CPU then in return causes the oil from the oil reservoir 64 to be released into the oil manifold 62 by the motor 68 wherein it travels to the hydraulic cylinder 90 through the oil inlet 94 and pushes the piercing rod 92 into engagement with part 25 for one of piercing or dimpling operations. As the piercing rod 92 is extended, one of the piercing assembly sensors 98 illuminates an LED and once the piercing rod 92 is retracted, the other of the piercing assembly sensors 98 illuminates another LED. The piercing sensors 98 measure and relay the piercing rod 92 position. The piercing assembly sensors 98 may concurrently communicate with the CPU 24 to relay the status of the piercing rod 92 operation.

Figure 7A:
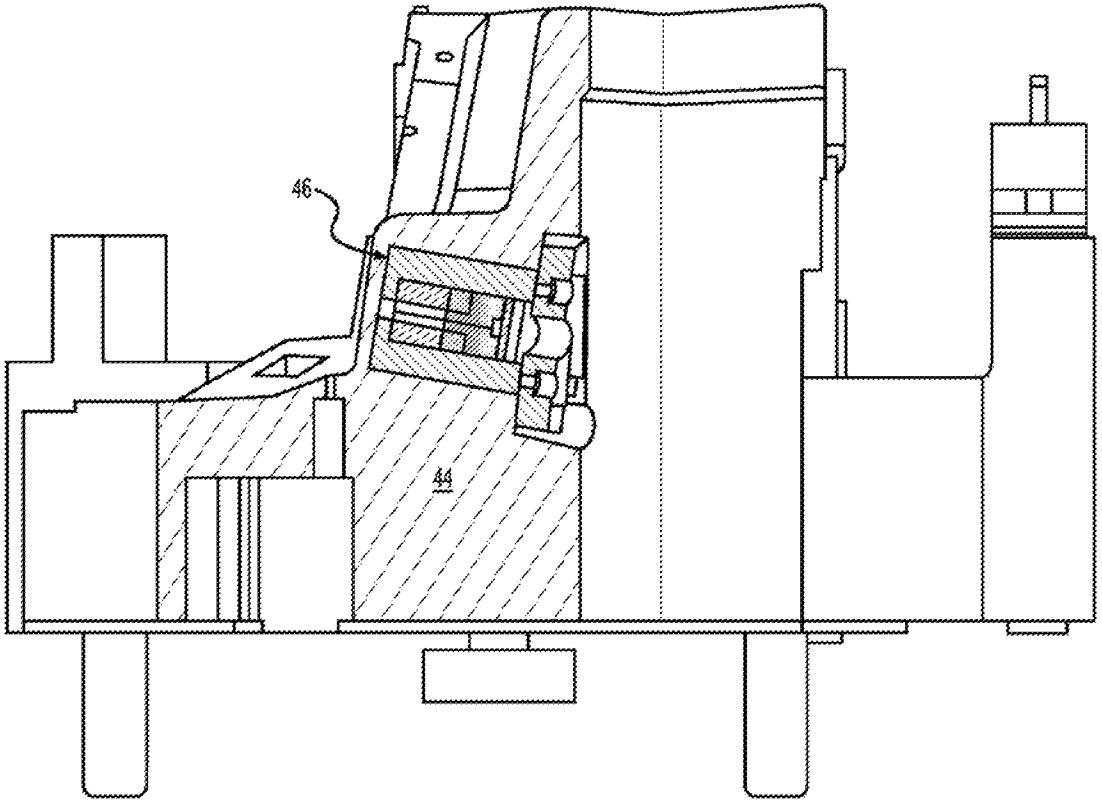
FIG. 7A is a side view of a punch and dimple assembly mounted on the upper die.
Figure 7B:
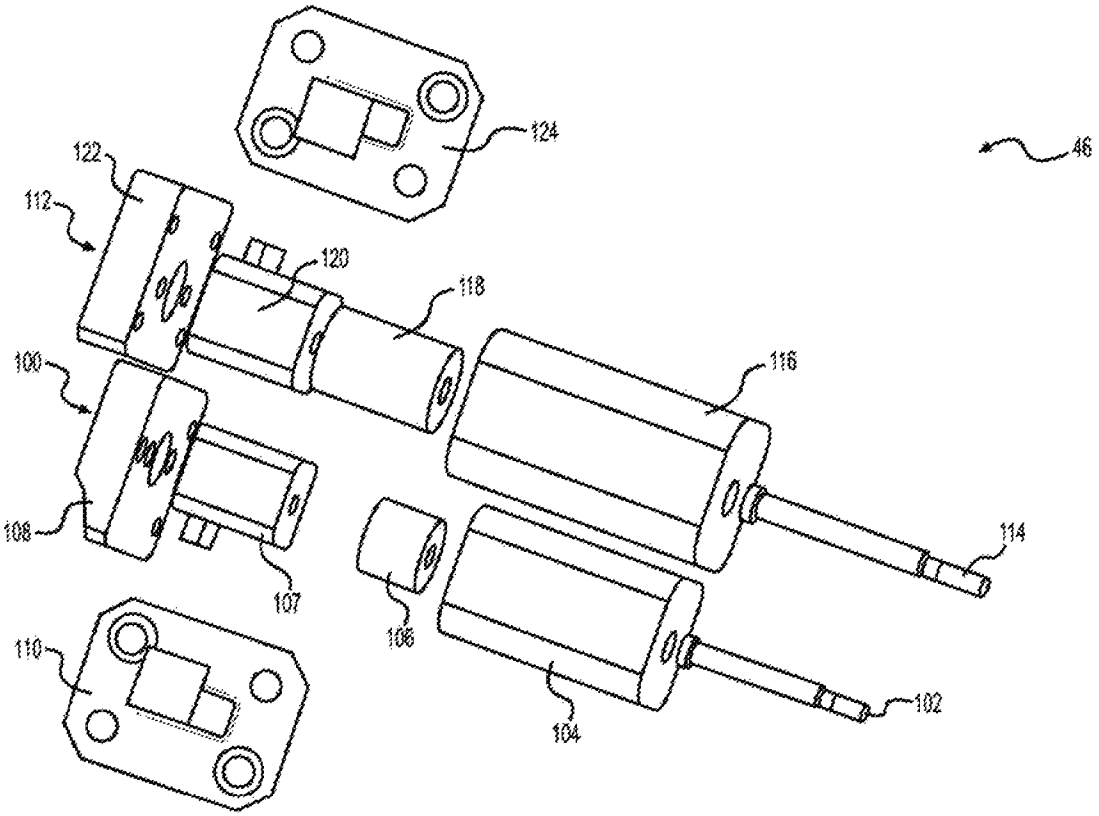
FIG. 7B is a side view of the punch and dimple assembly isolated from the upper die.

With reference now to FIGS. 7A and 7B, the punch and dimple assembly 46 is shown in greater detail. The punch and dimple assembly 46 is mounted to the upper pad 44 and performs certain dimpling and/or punching functionalities. As best illustrated in the disassembled view presented FIG. 7B, the punch and dimple assembly 46 includes a dimple apparatus 100 that includes a dimple punch 102 and a dimple guide block 104 that includes a cylindrical chamber for allowing the dimple punch 102 to slide therein. A retainer ring 106 is a damper (such as a coiled spring or elastic element) that compresses during dimpling and pushes the dimple punch 102 back to the retracted position. A dimple retainer 107 is mounted to the upper die 12 via a dimple stop and mount block 108 and a dimple return follower 110. The dimple retainer 107 connects the dimple guide block 104 to the upper die 12. The dimple and punch assembly 46 further includes a punch apparatus 112 that includes a punch rod 114 and a punch guide block 116 that includes a cylindrical chamber for allowing the punch rod 114 to slide therein. A retainer ring 118 is a damper (such as a coiled spring or elastic element) that compresses during punching and pushes the punch rod 114 back to the retracted position. A punch retainer 120 is mounted to the upper die 12 via a punch stop and mount block 122 and a punch return follower 124. The punch retainer 120 connects the punch guide block 116 to the upper die 12. Operation of one of both of the punching and dimpling functionalities of the punch and dimple assembly 46 may be facilitated by readings of a predetermined distance conveyed by one of sensors 22A-22D to the CPU 24. The CPU 24 may be configured to perform the punching and dimpling functionalities at the same or different predetermined distances and may each be associated with the same or a different sensor 22A-22D.

Figure 8B:
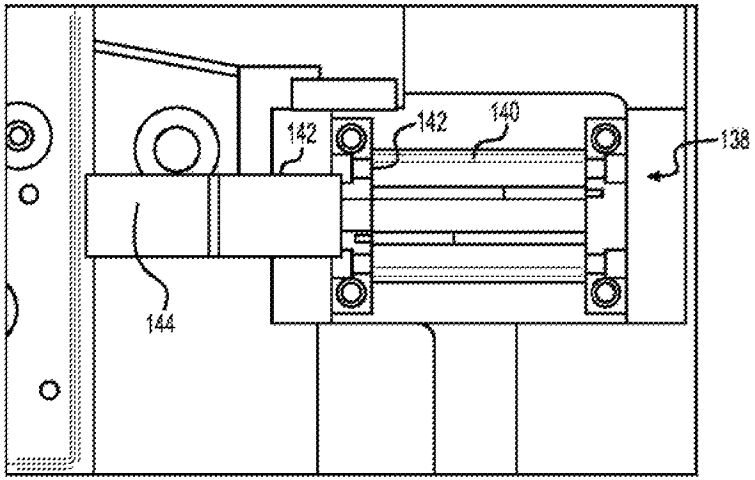
FIG. 8B is a top view of a secondary pressure block assembly in the extended position.
Figure 8A:
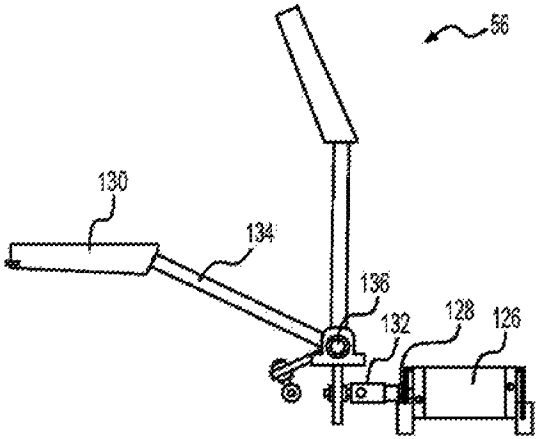
FIG. 8A is a side view of a pressure block assembly moving between an extended position and a retracted position.
Figure 8D:
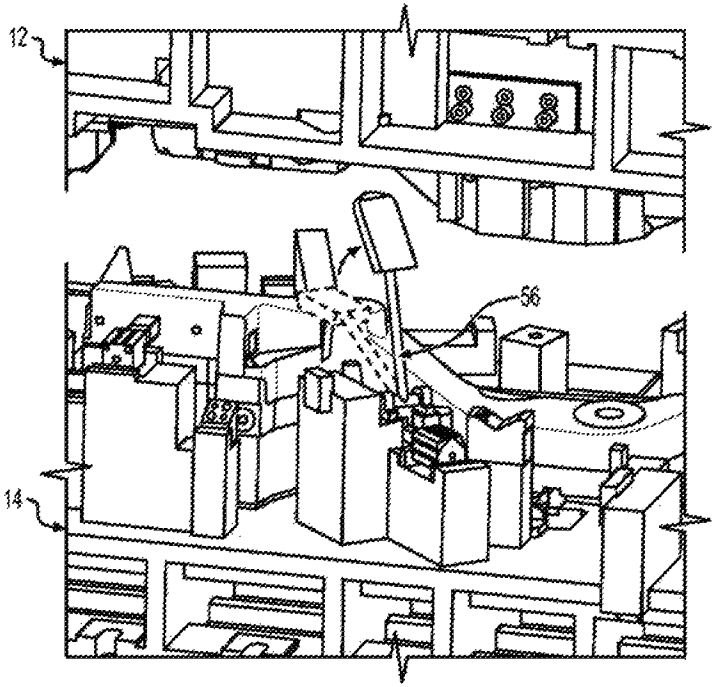
FIG. 8D is a perspective view of another pressure block assembly holding on to another location of the casted part.
Figure 8C:
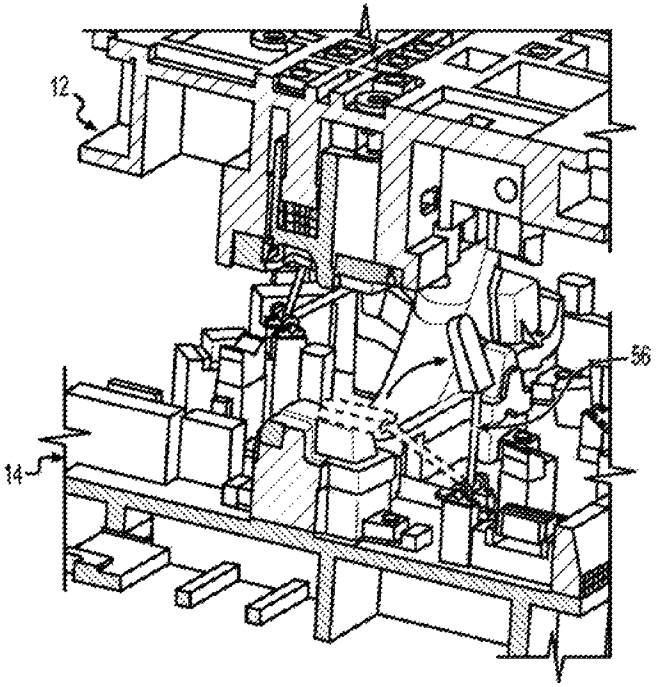
FIG. 8C is a perspective view of the pressure block assembly holding the casted part.

The lower pressure block assembly 56 configuration is best illustrated in FIGS. 8A through 8D. Each lower pressure block assembly 56 includes a pressure block air cylinder 126 and a pressure block air cylinder sensor 128. The pressure block air cylinder 126 and the pressure block air cylinder sensor 128 connects to a pressure block 130 via a connector 132. The pressure block air cylinder sensor 128 is in operable communication with the CPU 24 and measures and relays the pressure block air cylinder 126 position. The pressure block 130 extends from an elongate shaft 134 member to a rotating pin 136. As best illustrated in FIG. 8C, as the pressure block air cylinder 126 pushes the connector 132 outward, it pushes an end of the elongate shaft 134 that is opposite the pressure block 130 towards the part 25 and causes the pressure block 130 to rotate with respect to the rotating pin 136 towards the part 25. Operation of one of the lower pressure block assembly 56 functionality may be facilitated by readings of a predetermined distance (e.g., 500 mm) conveyed by one of sensors 22A-22D to the CPU 24. For example, as the predetermined distance (e.g., 500 mm) is reached, one of the sensors 22A-22D conveys a reading to the CPU 24. The CPU 24 in turn causes the pressure block air cylinder 126 to retract the connector 132 approximately 55 mm to cause the pressure block 130 to move into engagement with the part 25 to hold the part 25 in place as the upper die 12 and lower die 14 are moved further apart. Once the die has been opened to another predetermined distance (e.g., 600) then the readings are conveyed by one of sensors 22A-22D to the CPU 24 to cause the pressure block 130 to return to position. In addition to the pressure block assembly 56, a secondary pressure block assembly 138 may further be connected to the lower die 14. The secondary pressure block assembly 138 may be actuated in conjunction with or separately from the pressure block assemblies 56. The secondary pressure block assembly 138 includes a secondary air cylinder 140 and a secondary sensor 142 with a secondary pressure block 144 that moves linearly during actuation of the secondary air cylinder 140 to hold the part 25 in place. The secondary sensor 142 is in operable communication with the CPU 24 and measures and relays the secondary pressure block 144 position. The pressure block assemblies 56 and the secondary pressure block 144 are shown in a holding position in FIGS. 8C through 8D. The pressure block assembly 56 may be configured to hold the casted part for one or more of the trimming, piercing, punching, dimpling, and tapping operations. In one arrangement, the pressure block assembly 56 holds the part 25 after the trimming operation.

Figure 9A:
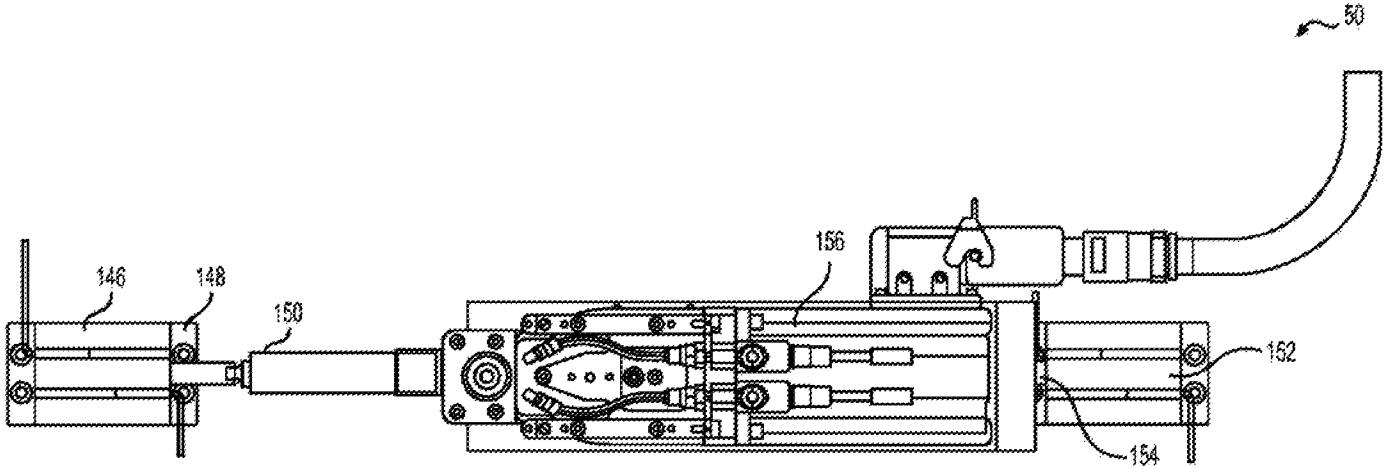
FIG. 9A is a side view of a tapping assembly for forming threaded holes in the casted part.
Figure 9B:
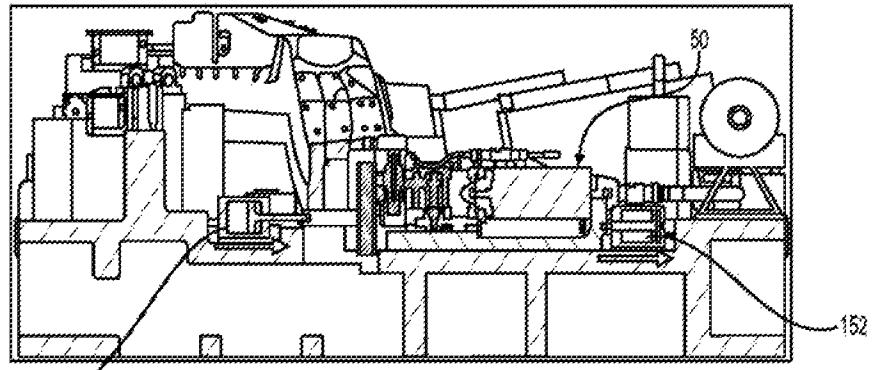
FIG. 9B is a cross-sectional view of the tapping assembly being moved away from the casted part.
Figure 9C:
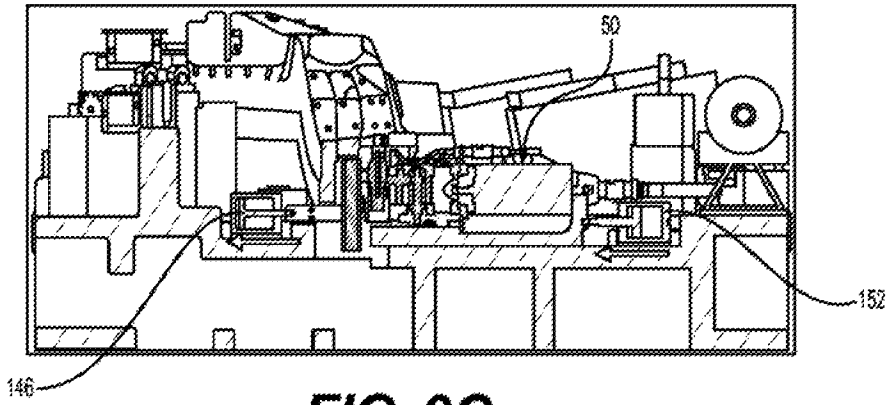
FIG. 9C is a cross-sectional view of the tapping assembly being moved towards the casted part.
Figure 9D:
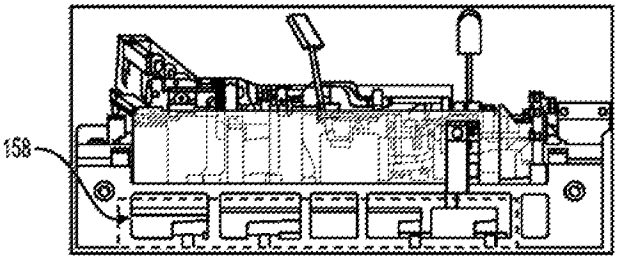
FIG. 9D is a cross-sectional view of a scrap chute located adjacent to the tapping assembly.
Figure 9E:
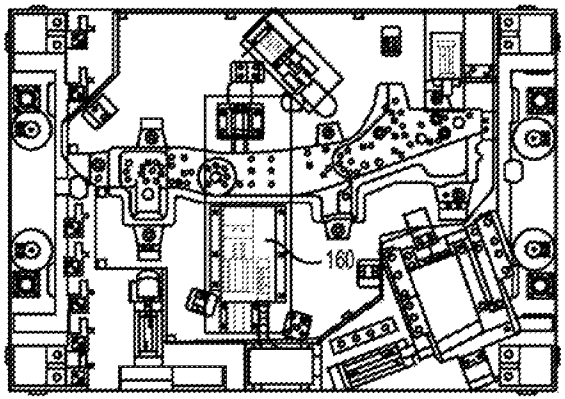
FIG. 9E is a top view of a protective plating located over the tapping assembly.

With reference now to FIG. 9A, a side view the tapping assembly 50 is illustrated. The tapping assembly 50 provides certain tapping functionalities such as forming treaded apertures in the part 25. The tapping assembly 50 includes a first tapping air cylinder 146 and a first tapping air cylinder sensor 148 in operable communication with a scrap chute 150 that collects scrap materials from the tapping operation. The first tapping air cylinder sensor 148 is in operable communication with the CPU 24 and measures and relays the first tapping air cylinder 146 position. The tapping assembly 50 further includes a second tapping air cylinder 152 and a second tapping air cylinder sensor 154 in operable communication with a tapping cam 156 that forms the threaded apertures. The second tapping air cylinder sensor 154 is in operable communication with the CPU 24 and measures and relays the second tapping air cylinder 152 position. In operation, once the die has been opened to another predetermined distance (e.g., 550 mm) then the readings are conveyed by one of sensors 22A-22D to the CPU 24 to cause the first tapping air cylinder 146 to move the scrap chute 150 to an open position. Then the CPU 24 further causes the second tapping air cylinder sensor 154 to drive the tapping cam 156 into the part 25. Then at another predetermined distance (e.g., 600 mm) then the readings are conveyed by one of sensors 22A-22D to cause the scrape chute 150 and tapping cam 156 to be retracted into their previous positions. Movement of the scrape chute 150 and tapping cam 156 are illustrated with arrows in FIGS. 9B and 9C, wherein the scrape chute 150 is extended in FIG. 9B and retracted in FIG. 9C and the tapping cam 156 is retracted in FIG. 9B and extended in FIG. 9C. FIG. 9D illustrates a side view of the tapping assembly 50 integrated in the lower die 14, wherein a scrap chamber 158 is located under the tapping assembly 50. FIG. 9E illustrates a top view of the tapping assembly 50 integrated in the lower die 14, wherein a protective plating 160 covers and protects the tapping assembly 50.

Figure 10:
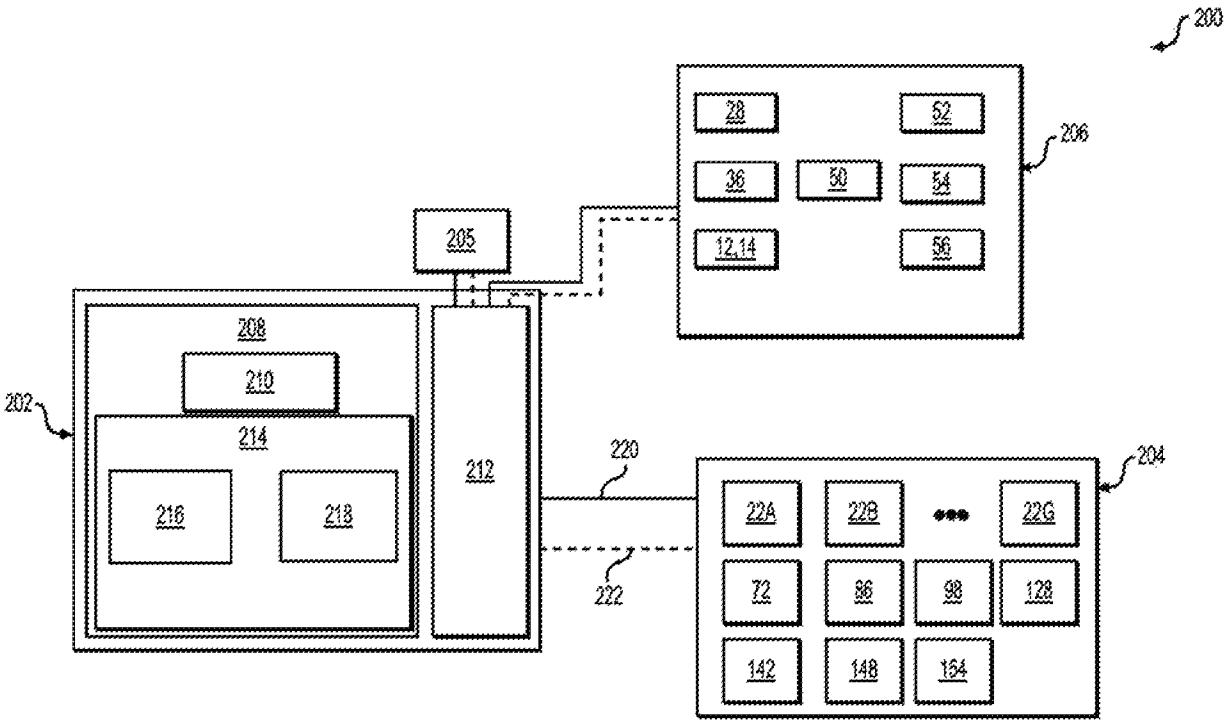
FIG. 10 is a schematic view of a casting assembly circuit.
Figure 11:
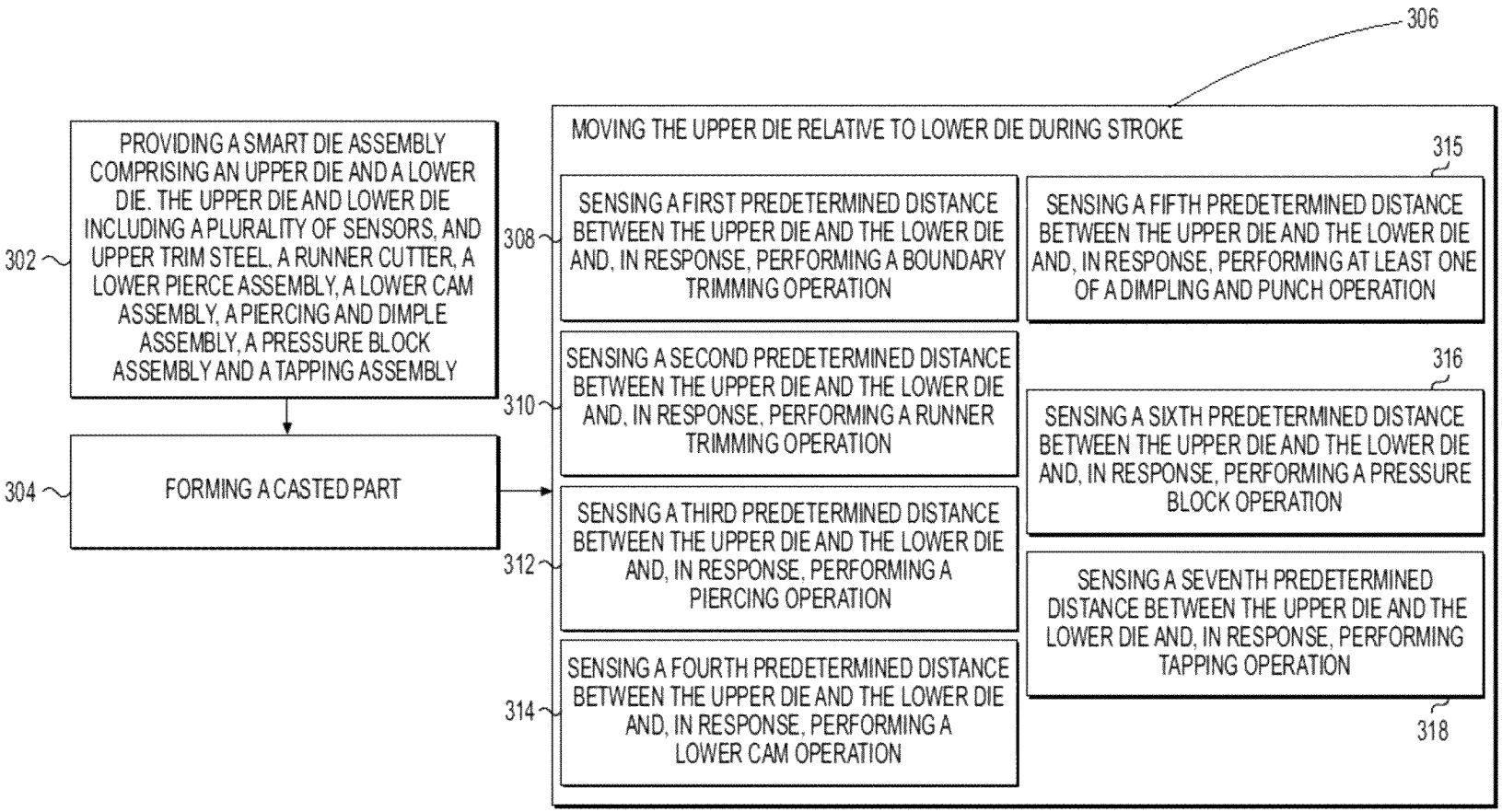
FIG. 11 is a flow chart illustrating a method of forming a part with the smart die assembly.

With reference now to FIG. 10, a casting assembly circuit 200 is presented. Elements of the casting assembly circuit 200 may be in a local or remote location. The various elements provided therein allow for a specific implementation. Thus, one of ordinary skill in the art of electronics and circuits may substitute various components to achieve a similar functionality. The casting assembly circuit 200 includes a CPU circuit 202 associated with CPU 24, a sensor system 204, as user interface system 205, and a casting operations circuit 206.

The CPU circuit 202 comprises a controller 208 that includes a processor 210, a communications unit 212 (for example associated with wired 220 or wireless 222 internet connection), and a memory 214 having machine-readable non-transitory storage. Programs and/or software 216 are saved on the memory 214 and so is data 218 obtained via the sensor system 204 and the user interface system 205. The processor 210 carries out instructions based on the software 216 and data 218, for example, providing instructions to the casting operations circuit 206 to perform one of the piercing, holding, punching, dimpling, and tapping operations described previously. Communications between the CPU circuit 202, the sensor system 204, the user interface system 205, and the casting operations circuit 206 are communicated to and from the communications unit 212 (wired 220 or wireless 222), allowing one or both of transmittal and receipt of information. As such, software 216 and data 218 may be updated via instructions from the user interface system 205.

The sensor system 204 includes sensors 22A-22D that communicates readings of predetermined threshold values to the CPU circuit 202, which in response communicates certain operations to the casting operations circuit 206. Each sensor 22A-22D may be associated with a specific predetermined threshold and casting operations. The casting operations of the casting operations circuit 206 include the upper trim plate 28, the runner cutters 36, movement of the upper and lower dies 12, 14, the lower pierce assembly 54, the lower CAM assembly 52, the pressure block assembly 56, and the tapping assembly 50. In addition, the sensor system 204 includes the first cylinder sensor 72, the second cylinder sensor 86, first and second piercing assembly sensor 98, the pressure block air cylinder sensor 128, the secondary sensor 142, first tapping air cylinder sensor 148, and second tapping air cylinder sensor 154. As such, certain safety protocols may be stored within the memory 214 such that individual operations are complete before the CPU 24 initiates future operations. For example, if the piercing rod 92 does not become retracted because of a malfunction, the CPU 24 may prevent any subsequent operations and may further stop the upper die 12 from moving relative to the lower die 14 until the smart trim die assembly 10 can be examined.

The predetermined threshold values and their association with certain casting operations can be saved in the memory 214. For example, after casting the part 25, the smart trim die assembly 10 returns to an open position, maximum or otherwise predetermined, such as the upper die 12 and lower die 14 being located 1085 mm apart. Then a stroke is facilitated, wherein the upper die 12 is moved towards the lower die 14. The stroke may be facilitated by independent mechanisms that are used for loading traditional die assemblies that may or may not be directed by the CPU 24. As the smart trim die assembly 10 closes to 100 mm apart, communications from a first sensor 22A to the CPU 24 may cause the lower CAM assembly 52 to move towards the part 25. As the smart trim die assembly 10 closes to 40 mm apart, the gas springs 34 compress and the upper pad 44 presses the part 25. As the smart trim die assembly 10 closes to 25 mm apart, the runner cutters 36 cut the runners. As the smart trim die assembly 10 closes to 10 mm apart, communications from a second sensor 22B to the CPU 24 may cause the punch and dimple assembly 46 to move towards the part 25 and provide one or both of dimpling and punching functionality. As the smart trim die assembly 10 closes to 8 mm apart, the upper trim plate 28 trims the boundary of the part 25. As the smart trim die assembly 10 closes to 6 mm apart, the upper punches begin punching operations on the part 25. As the smart trim die assembly 10 closes completely, the upper pad 44 restrikes the part 25. After bottoming out, the smart trim die assembly 10 opens back up to 200 mm apart, and communications from a third sensor 22C to the CPU 24 may cause the lower CAM assembly 52 to move away from the part 25. As the smart trim die assembly 10 opens to 500 mm apart, communications from a fourth sensor 22D to the CPU 24 may cause the pressure block assembly 56 to move towards and into holding engagement with the part 25. As the smart trim die assembly 10 opens to 550 mm apart, communications from a fifth sensor 22E to the CPU 24 may cause the tapping assembly 50 to extend the tapping cam 156 to form threaded holes in the part 25 and to open the chute 150. As the smart trim die assembly 10 opens to 600 mm apart, communications from a sixth sensor 22F to the CPU 24 may cause the tapping assembly 50 to be moved into the retracted position. As the smart trim die assembly 10 closes to 650 mm apart, communications from a seventh sensor 22G to the CPU 24 may cause the pressure block assembly 56 to move away from and release the part 25 such that it can be removed from the smart trim die assembly 10.

The subject invention further includes a method of forming a part with a smart trim die assembly. The method includes providing 302 a smart die assembly comprising an upper die 12 and lower die 14. The upper die 12 and/or lower die 14 includes a plurality of sensors 22A-22G, an upper trim plate 28, a runner cutter 26, a lower pierce assembly 54, a lower CAM assembly 52, a punch and dimple assembly 46, a pressure block assembly 56, and a tapping assembly 50. The method continues by forming 304 a casted part. After the part is formed 304, the method continues by moving the upper die relative to the lower die. The step 306 includes sensing a first predetermined distance 308 between the upper and lower die and, in response, performing a boundary trimming operation with the upper trim plate. The step 306 further includes sensing a second predetermined distance 310 (with or without a different sensor) between the upper and lower die and, in response, performing a runner trimming operation with the runner cutters. The step 306 further includes sensing a third predetermined distance 312 (with or without a different sensor) between the upper and lower die and, in response, performing a piercing operation with the lower pierce assembly. The step 306 further includes sensing a fourth predetermined distance 314 (with or without a different sensor) between the upper and lower die and, in response, performing a lower CAM operation with the lower CAM assembly. The step 306 further includes sensing a fifth predetermined distance 315 (with or without a different sensor) between the upper and lower die and, in response, performing a dimpling or punching operation. The step 306 further includes sensing a sixth predetermined distance 316 (with or without a different sensor) between the upper and lower die and, in response, performing a pressure block operation with the pressure blocks. The step 306 further includes sensing a seventh predetermined distance 318 (with or without a different sensor) between the upper and lower die and, in response, performing a tapping operation with the tapping assembly.

Unless otherwise provided, the number and order of operations can vary without departure from the subject disclosure. References to the upper die 12 and lower die 14 and various components located thereon could be arranged. For example, a component described as being provided on the upper die 14 could alternatively be located on the lower die 16 or vice versa. Certain operations, such as runner trimming may be facilitated by sensor readings or occur automatically based on the runner cutter 36 location independent of the sensor.

It should be appreciated that the foregoing description of the embodiments has been provided for purposes of illustration. In other words, the subject disclosure it is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varies in many ways. Such variations are not to be regarded as a departure from the disclosure, and all such modifications are intended to be included within the scope of disclosure.

The invention claimed is:

1. A smart trim die assembly comprising:

a first die and a second die moveable relative to the first die between an open position and a closed position during a stroke, and a cavity formed between the first die and the second die in the closed position for casting a part;

an upper trim plate for trimming a boundary around the part when the first die and the second die are moved into close proximity;

at least one sensor for measuring a distance between the first die and the second die;

a first tool integrated into the first die or the second die for performing one of piercing, holding, punching, dimpling, and tapping operations;

a processor; and a memory device for receiving measurements from the at least one sensor, the memory device further containing instructions that, when executed by the processor, cause the processor to, in response to the at least one sensor reading a first predetermined distance:

instruct the first tool to perform one of the piercing, holding, punching, dimpling, and tapping operations.

2. The smart trim die assembly of claim 1, wherein the first tool includes a punch and dimple assembly for dimpling certain regions of the part.

3. The smart trim die assembly of claim 1, wherein the first tool includes a punch and dimple assembly for punching certain regions of the part.

4. A smart trim die assembly comprising:

a first die and a second die moveable relative to the first die between an open position and a closed position during a stroke, and a cavity formed between the first die and the second die in the closed position for casting a part;

a runner cutter for trimming runners around the part when the first die and the second die are moved into close proximity at least one sensor for measuring a distance between the first die and the second die;

a first tool integrated into the first die or the second die for performing one of piercing, holding, punching, dimpling, and tapping operations;

a processor; and a memory device for receiving measurements from the at least one sensor, the memory device further containing instructions that, when executed by the processor, cause the processor to, in response to the at least one sensor reading a first predetermined distance:

instruct the first tool to perform one of the piercing, holding, punching, dimpling, and tapping operations.

5. A smart trim die assembly comprising:

a first die and a second die moveable relative to the first die between an open position and a closed position during a stroke, and a cavity formed between the first die and the second die in the closed position for casting a part;

at least one sensor for measuring a distance between the first die and the second die;

a first tool integrated into the first die or the second die for performing one of piercing, holding, punching, dimpling, and tapping operations, wherein the first tool includes a lower pierce assembly for piercing certain regions of the part;

a processor; and a memory device for receiving measurements from the at least one sensor, the memory device further containing instructions that, when executed by the processor, cause the processor to, in response to the at least one sensor reading a first predetermined distance:

instruct the first tool to perform one of the piercing, holding, punching, dimpling, and tapping operations.

6. The smart die assembly of claim 5, further including a lower CAM assembly for moving the lower pierce assembly relative to the part.

7. The smart die assembly of claim 6, wherein the CAM assembly includes a first cylinder for moving the lower pierce assembly relative to the part in a first direction.

8. The smart die assembly of claim 7, wherein the CAM assembly further includes a second cylinder for moving the lower pierce assembly relative to the part in a second direction that is transverse to the first direction.

9. A smart trim die assembly comprising:

a first die and a second die moveable relative to the first die between an open position and a closed position during a stroke, and a cavity formed between the first die and the second die in the closed position for casting a part;

at least one sensor for measuring a distance between the first die and the second die;

a first tool integrated into the first die or the second die for performing one of piercing, holding, punching, dimpling, and tapping operations, wherein the first tool includes a tapping assembly for providing threaded apertures to certain regions of the part;

a processor; and a memory device for receiving measurements from the at least one sensor, the memory device further containing instructions that, when executed by the processor, cause the processor to, in response to the at least one sensor reading a first predetermined distance:

instruct the first tool to perform one of the piercing, holding, punching, dimpling, and tapping operations.

10. The smart trim die assembly of claim 9, further including a scrap chute located near the tapping assembly for providing a space for scrap metal during operation of the tapping assembly.

11. The smart trim die assembly of claim 9, further including at least one cylinder moving the tapping assembly towards the part before the threaded apertures are formed.

12. The smart trim die assembly of claim 9, further comprising a second tool that includes at least one pressure block assembly that holds the part while the threaded apertures are formed and releases the part after the threaded apertures are formed.

13. A smart trim die assembly comprising:

a first die and a second die moveable relative to the first die between an open position and a closed position during a stroke, and a cavity formed between the first die and the second die in the closed position for casting a part;

at least one sensor for measuring a distance between the first die and the second die;

a first tool integrated into the first die or the second die for performing one of piercing, holding, punching, dimpling, and tapping operations;

a second tool and a second sensor for measuring a second predetermined distance that is different than the first predetermined distance, wherein in response to the second sensor reading the second predetermined distance the processor instructs the second tool to perform one of the piercing, holding, punching, dimpling, and tapping operations that is different than the first tool a processor; and a memory device for receiving measurements from the at least one sensor, the memory device further containing instructions that, when executed by the processor, cause the processor to, in response to the at least one sensor reading a first predetermined distance:

instruct the first tool to perform one of the piercing, holding, punching, dimpling, and tapping operations.

14. The smart trim die assembly of claim 13, further including a third tool and a third sensor for measuring a third predetermined distance that is different than the first predetermined distance and the second predetermined distance, wherein in response to the third sensor reading the third predetermined distance the processor instructs the third tool to perform one of the piercing, holding, punching, dimpling, and tapping operations that is different than the first tool and the second tool.

15. A smart trim die assembly comprising:

a first die and a second die moveable relative to the first die between an open position and a closed position during a stroke, and a cavity formed between the first die and the second die in the closed position for casting a part;

an upper trim plate for trimming a boundary around the part when the first die and the second die are moved into close proximity;

at least one sensor;

a first tool for performing at least one of a piercing, holding, punching, dimpling, and tapping operation; and a memory device for receiving measurements from the at least one sensor and causing the first tool to perform at least one of the piercing, holding, punching, dimpling, and tapping operation.

16. A smart trim die assembly comprising:

a first die and a second die moveable relative to the first die between an open position and a closed position during a stroke, and a cavity formed between the first die and the second die in the closed position for casting a part;

a runner cutter for trimming runners around the part when the first die and the second die are moved into close proximity;

at least one sensor;

a first tool for performing at least one of a piercing, holding, punching, dimpling, and tapping operation; and a memory device for receiving measurements from the at least one sensor and causing the first tool to perform at least one of the piercing, holding, punching, dimpling, and tapping operation.

17. A smart trim die assembly comprising:

a first die and a second die moveable relative to the first die between an open position and a closed position during a stroke, and a cavity formed between the first die and the second die in the closed position for casting a part;

at least one sensor;

a first tool for performing at least one of a piercing, holding, punching, dimpling, and tapping operation, wherein the first tool includes a lower pierce assembly for piercing certain regions of the part; and a memory device for receiving measurements from the at least one sensor and causing the first tool to perform at least one of the piercing, holding, punching, dimpling, and tapping operation.

18. The smart trim die assembly of claim 17, further including a lower CAM assembly for moving the lower pierce assembly relative to the part.

* * * * *